US009065217B2

(12) United States Patent
Tang et al.

(10) Patent No.: US 9,065,217 B2
(45) Date of Patent: Jun. 23, 2015

(54) HIGH SPEED RJ45 CONNECTOR HAVING MAGNETIC MODULE

(71) Applicant: HON HAI PRECISION INDUSTRY CO., LTD., New Taipei (TW)

(72) Inventors: Zhi-Hui Tang, Kunshan (CN); Zhi-Cheng Zhang, Kunshan (CN); Xiao-Dong Yang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/135,558

(22) Filed: Dec. 19, 2013

(65) Prior Publication Data

US 2014/0170904 A1 Jun. 19, 2014

(30) Foreign Application Priority Data

Dec. 19, 2012 (CN) ..... 2012 1 05540929

(51) Int. Cl.
*H01R 13/66* (2006.01)
*H01R 24/64* (2011.01)

(52) U.S. Cl.
CPC ..... *H01R 13/6633* (2013.01); *H01R 24/64* (2013.01)

(58) Field of Classification Search
CPC ..... H01R 24/64; H01R 13/6658; H01R 13/6466; H01R 13/6633
USPC ..... 439/620.15, 620.23, 620.24, 620.13, 439/620.17, 620.05
See application file for complete search history.

(56) References Cited

U.S. PATENT DOCUMENTS

| | | | | |
|---|---|---|---|---|
| 5,736,910 | A | 4/1998 | Townsend | |
| 7,510,441 | B2 * | 3/2009 | Zhang et al. | 439/620.18 |
| 7,596,864 | B2 | 10/2009 | Chow | |
| 7,749,027 | B2 * | 7/2010 | Chow et al. | 439/620.15 |
| 7,785,135 | B2 | 8/2010 | Wu | |
| 7,841,902 | B2 * | 11/2010 | Chow et al. | 439/620.15 |
| 8,093,980 | B2 | 1/2012 | Asou | |
| 8,272,898 | B2 | 9/2012 | Chow | |
| 8,439,711 | B2 * | 5/2013 | Wang et al. | 439/676 |
| 8,535,100 | B2 * | 9/2013 | Ge et al. | 439/620.17 |

FOREIGN PATENT DOCUMENTS

TW M437561 U1 9/2012

* cited by examiner

*Primary Examiner* — Xuong Chung Trans
(74) *Attorney, Agent, or Firm* — Wei Te Chung; Ming Chieh Chang

(57) ABSTRACT

An electrical connector including a housing, a plurality of contacts fastened in the housing for mating with a plug, a plurality of terminals for connecting an electrical device, and a magnetic module electrically connecting the contacts and the terminals to form a number of signal channels carrying differential signal pairs. The magnetic module has a printed circuit board (PCB) and a transformer mounted thereon. The transformer is connected in one of the signal channels and comprises an H-shaped magnetic core, a magnetic board a primary coil having a first magnetic wire and a second magnetic wire, and a secondary coil having a third magnetic wire and a fourth magnetic wire. The wires have specific parameters to suit specific needs.

19 Claims, 12 Drawing Sheets

HIGH SPEED RJ45 CONNECTOR HAVING MAGNETIC MODULE

BACKGROUND OF THE INVENTION

1. Field of the Invention

The present invention relates to a high speed connector, and more specifically to a magnetic module of a high speed connector.

2. Description of Related Art

Taiwan utility patent No. M437561U1 issued on Sep. 11, 2012 discloses an electrical connector having an RJ45 port stacked above a stacked double USB connector. The electrical connector has printed circuit board (PCB) loaded with two transformers and two common mode chokes mounted on a back face of the PCB. The PCB used in this electrical connector has a large area where the transformers and the common mode chokes could be mounted. However, there is a trend of miniaturization in connector size and it is always a difficulty to reconcile the contradictions between the small size and good electrical performance.

U.S. Pat. No. 8,093,980, issued to Asou et al. on Jan. 10, 2012, discloses a surface mount pulse transformer for being used for a connector constituting a connection point of a cable and an equipment.

In view of the foregoing, the present invention is to provide an electrical connector having a transformer with small size, high electric performance and suit manufacturability.

SUMMARY OF THE INVENTION

Accordingly, an object of the present invention is to provide a high speed connector comprising a housing, a plurality of contacts fastened in the housing for mating with a plug, a plurality of terminals for connecting an electrical device, a magnetic module electrically connecting the contacts and the terminals to form a plurality of signal channels carrying differential signal pairs. The magnetic module has a printed circuit board (PCB) and a transformer mounted thereon. The transformer is connected in one of the signal channels and comprises an H-shaped magnetic core, a magnetic board a primary coil having a first magnetic wire and a second magnetic wire, and a secondary coil having a third magnetic wire and a fourth magnetic wire. The H-shaped magnetic core has a body portion extending along a horizontally longitudinal direction and defining a horizontally transverse direction and a vertical direction, a first and a second walls perpendicular to the longitudinal direction and respectively connected to longitudinal opposite ends of the body portion. Each of the first and the second walls has a plurality of electrode pads disposed along the transverse direction on a bottom side thereof The magnetic board covers across the body portion and supported by the first and second walls. Each of the first to fourth magnetic wires has a middle portion winding around the body portion, a first end and an opposite second end connected to the electrode pads, the electrode pads soldered onto the PCB so that the first and the second magnetic wires are serially connected to form an output, an input and a center tap of the primary coil, the third and the fourth magnetic wires are serially connected to form an output, an input and a center tap of the secondary coil. The output and input of the primary coil are respectively electrically connected to two of the contacts through some circuits of the PCB, and the output and input of the secondary coil are respectively electrically connected to two of the terminals through some other circuits of the PCB. Each of the first to fourth magnetic wires is made from a copper wire having a diameter of 0.027 to 0.05 millimeters coated with an insulating paint, the body portion having a longitudinal length greater than twice of a product of the diameter and the turn number, the primary coil having a direct-current resistant of no more than 5 ohms between the input and the output of the primary coil and an inductance of 150 micro henries at a frequency of 100 KHz, and the secondary coil having a direct-current resistant of no more than 5 ohms between the input and the output of the secondary coil and an inductance of 150 micro henries at a frequency of 100 KHz.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring FIGS. 1-12, a single-port RJ45 connector 100 and its circuit diagram are shown. The RJ45 connector 100 has a speed of above 1 Gigabit/s when applied above 100 MHz.

Figure 1:
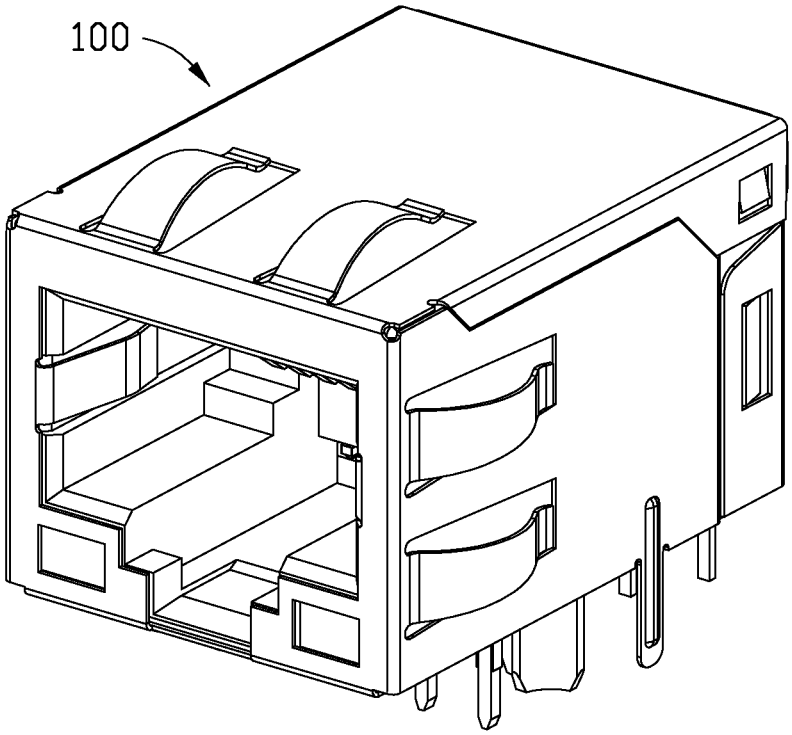
FIG. 1 is a perspective view of an electrical connector according to the preferred embodiment of the instant invention.
Figure 2:
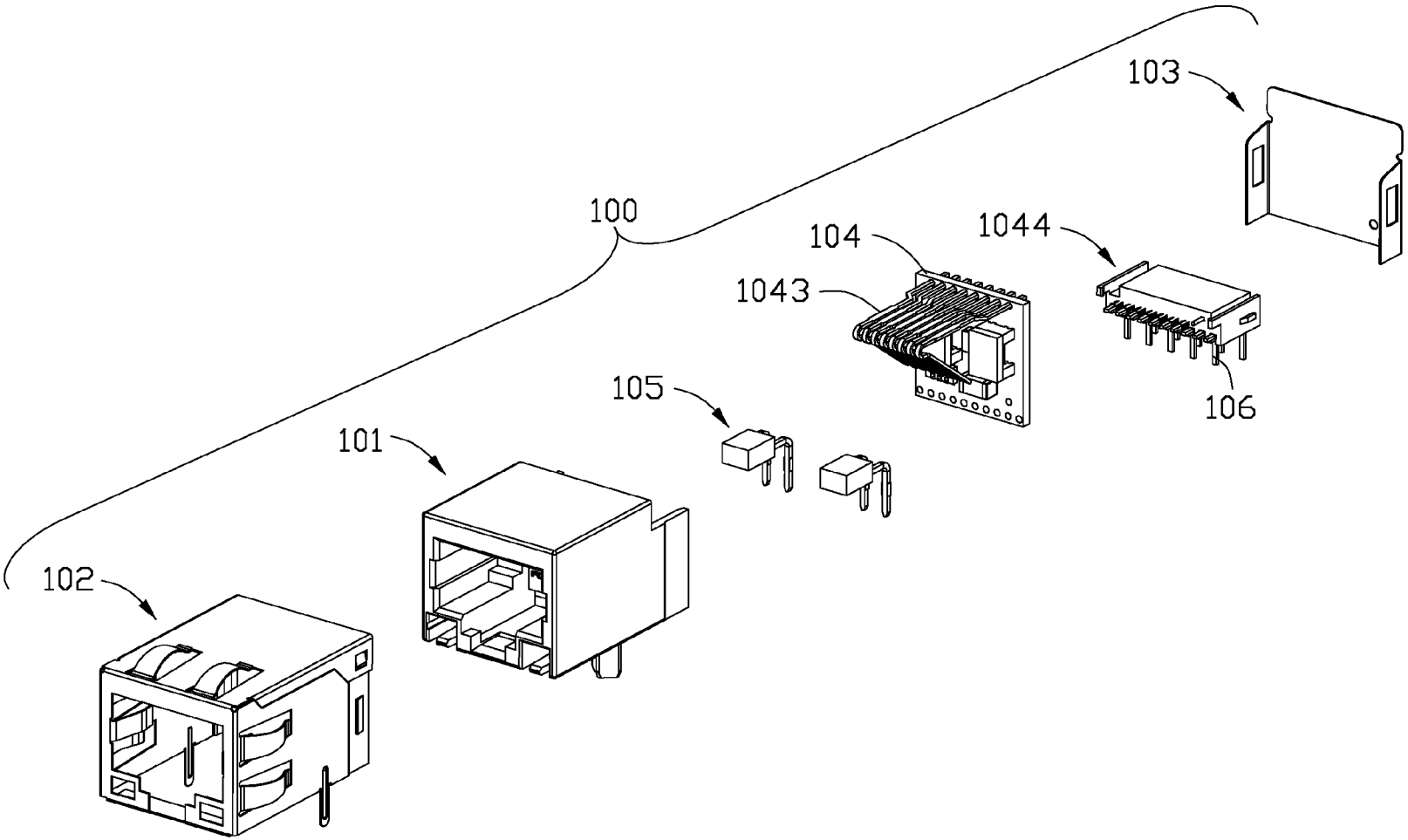
FIG. 2 is an exploded view of the electrical connector shown in FIG. 1.
Figure 3:
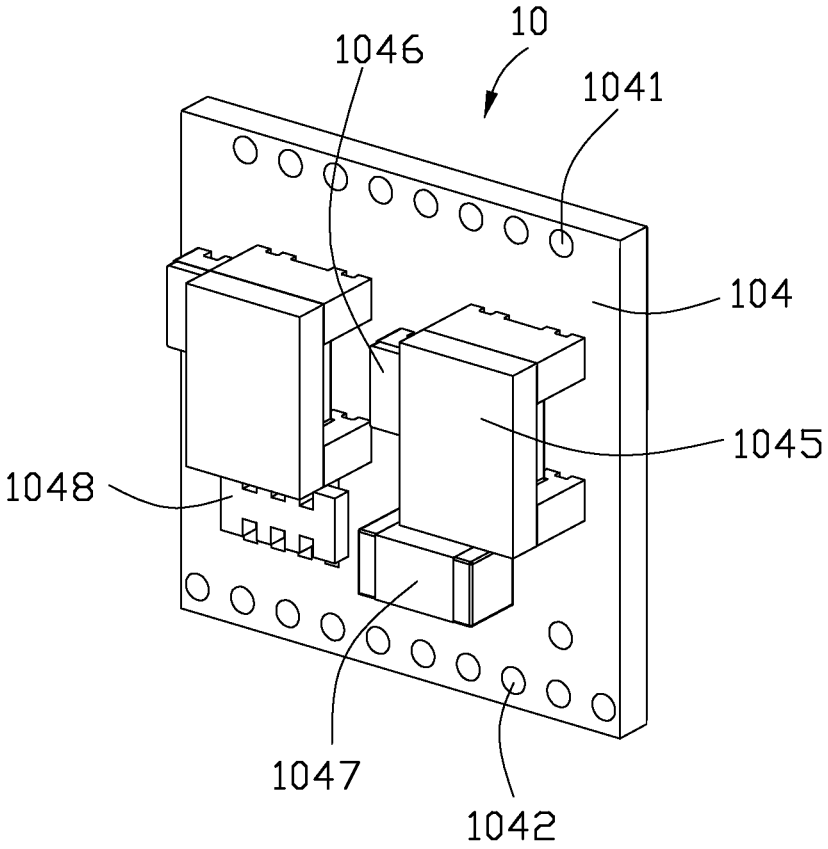
FIG. 3 is a front perspective view of the magnetic module shown in FIG. 2.
Figure 4:
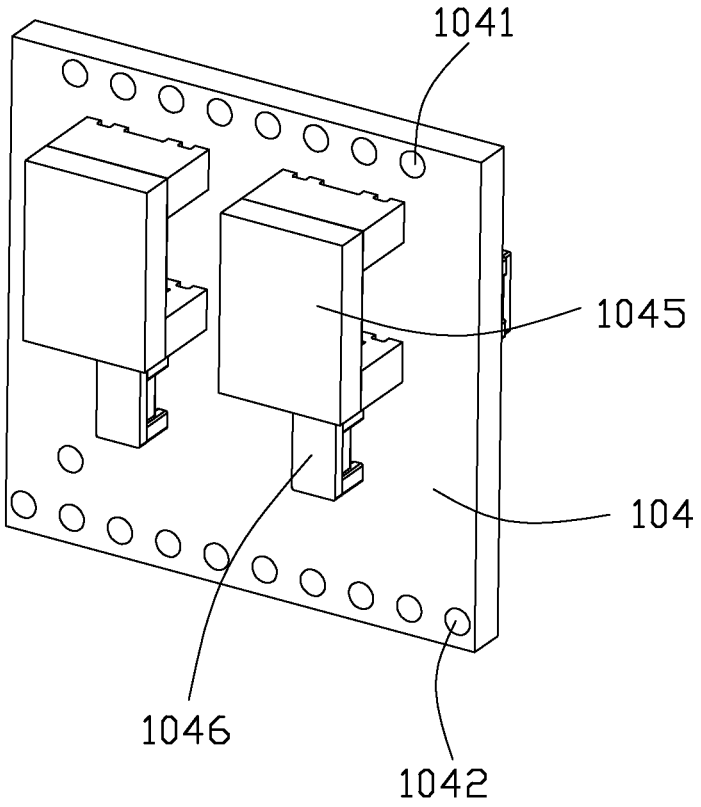
FIG. 4 is a rear perspective view of the magnetic module shown in FIG. 2.
Figure 5:
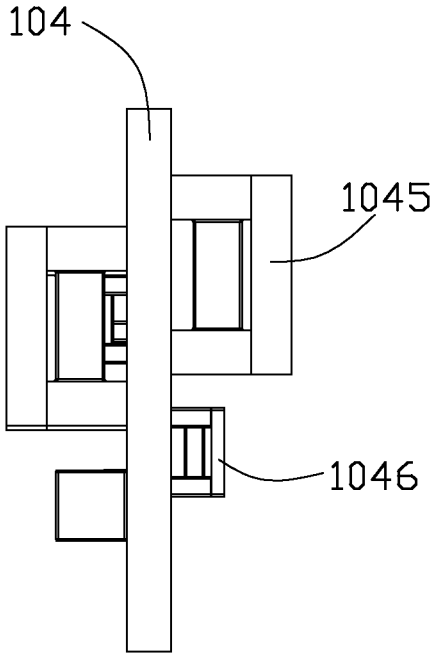
FIG. 5 is a side view of the magnetic module shown in FIG. 2.
Figure 6:
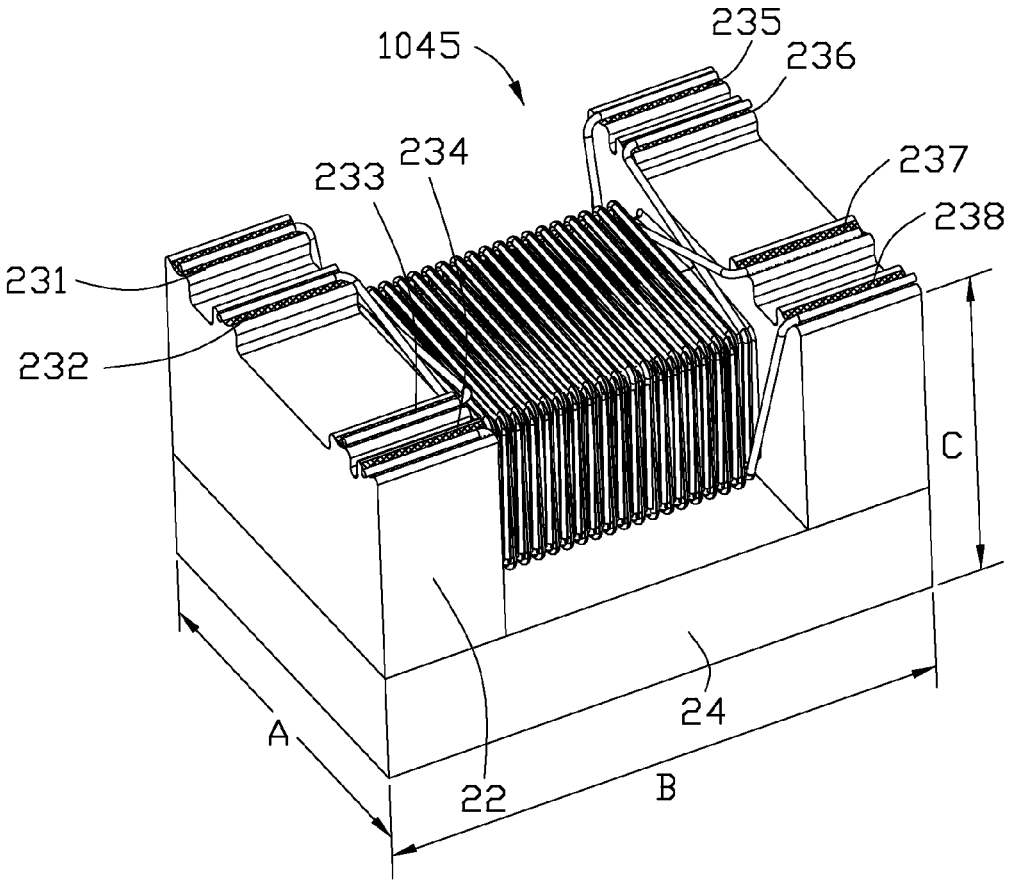
FIG. 6 is a perspective view of the transformer shown in FIGS. 3-5.
Figure 7:
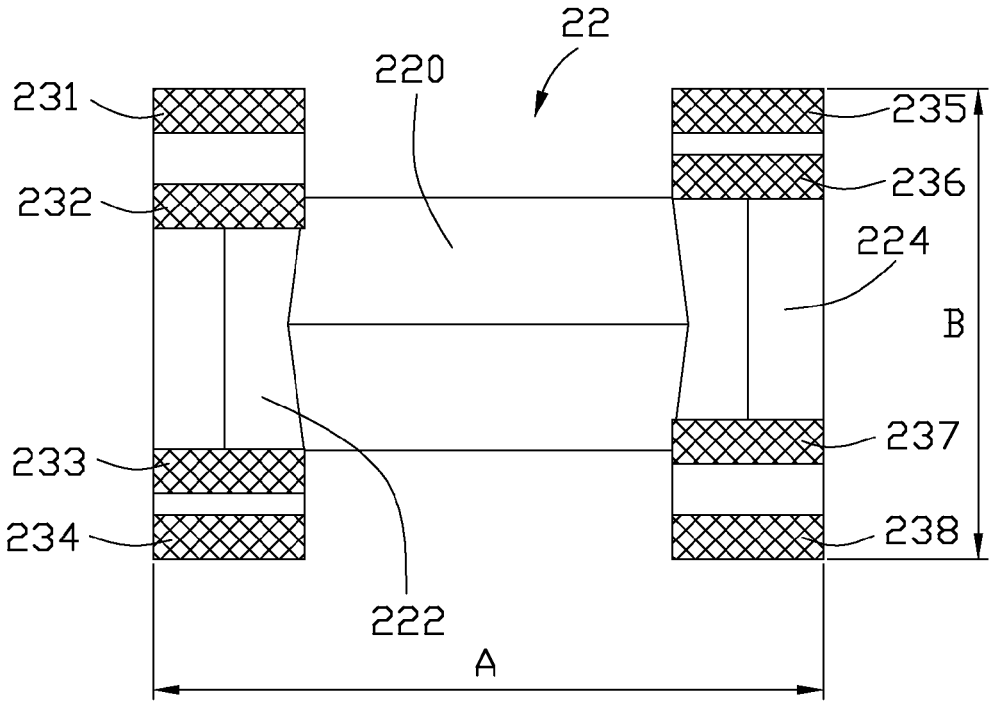
FIG. 7 is a top view of the H-shaped magnetic core shown in FIG. 6.
Figure 8:
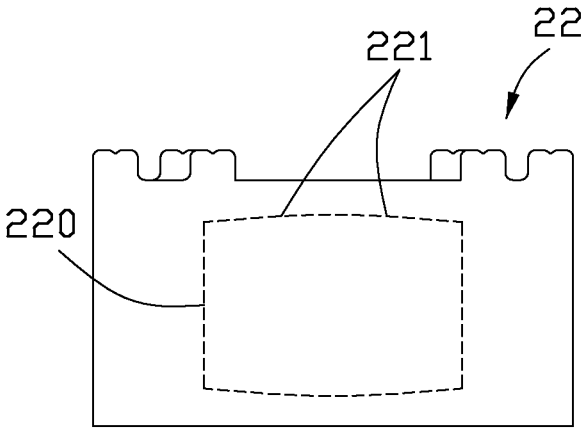
FIG. 8 is a side view of the H-shaped magnetic core shown in FIG. 7.
Figure 9:
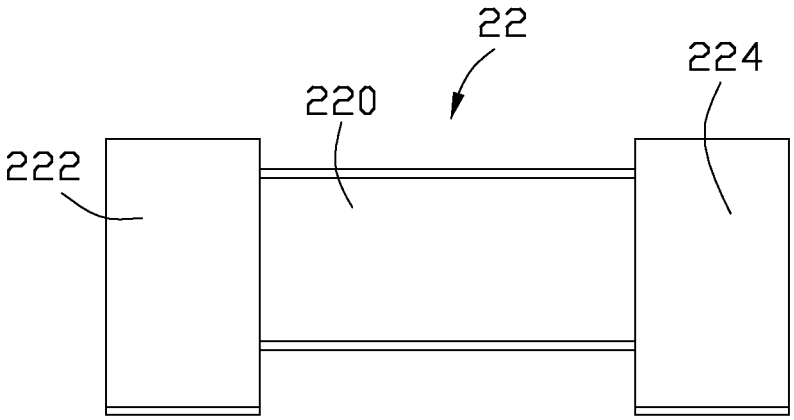
FIG. 9 is a top view of the H-shaped magnetic core shown in FIG. 7.
Figure 10:
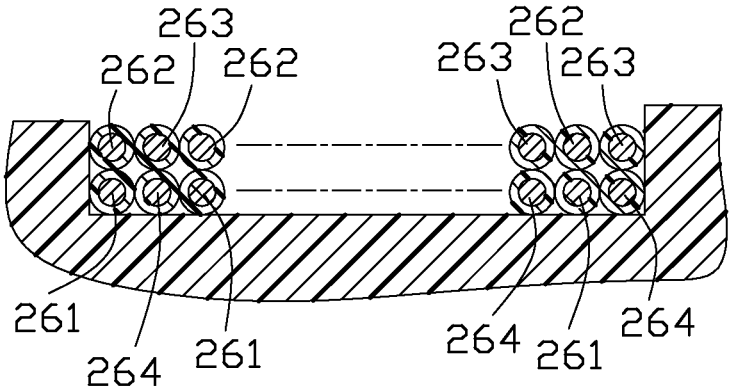
FIG. 10 is an enlarged partial cross section view showing the state of the first to fourth magnetic wires winding around the H-shaped magnetic core.
Figure 11:
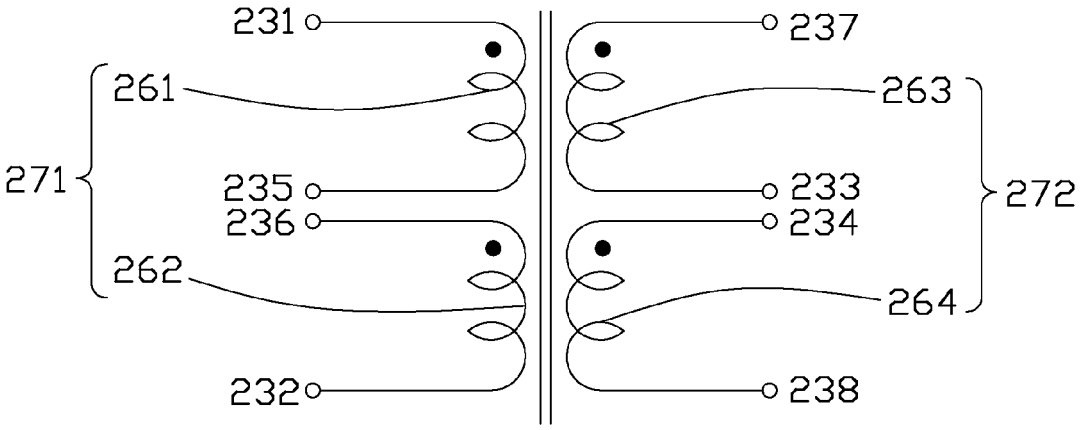
FIG. 11 is a circuit diagram of the transformer of present invention.
Figure 12:
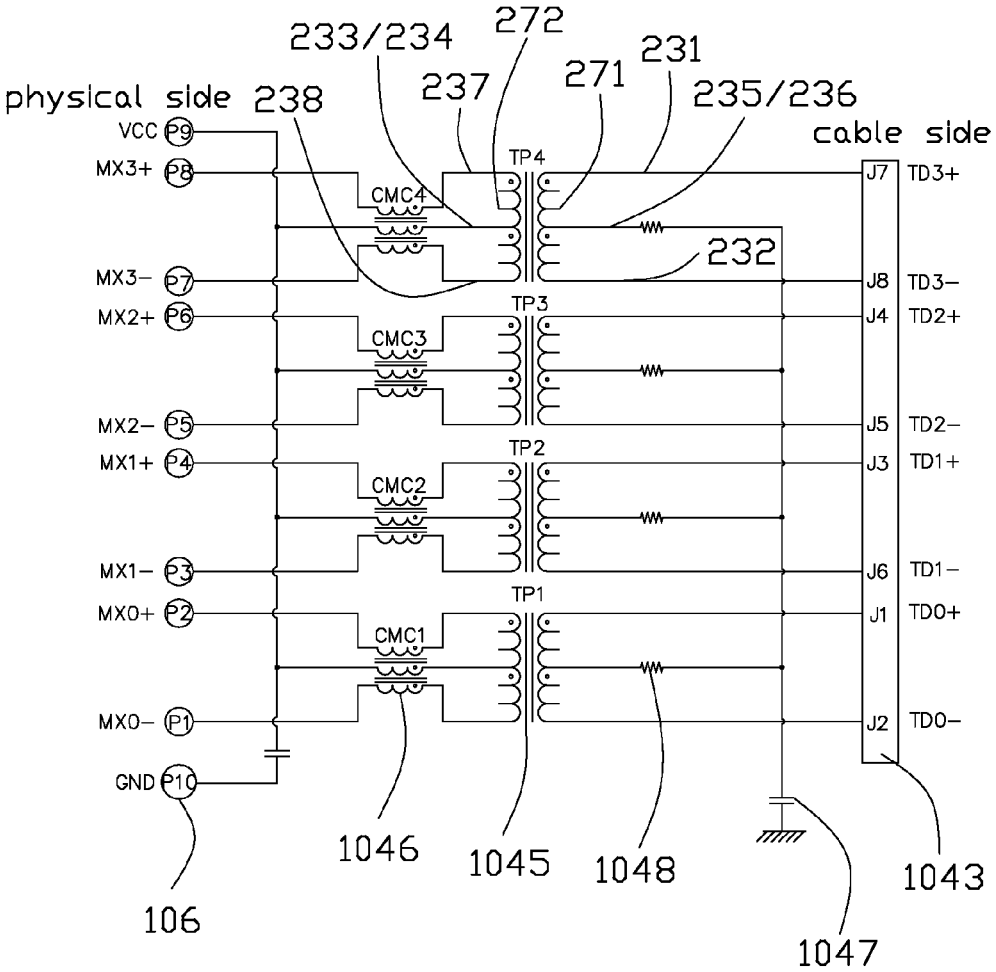
FIG. 12 is a circuit diagram of the electrical connector shown in FIG. 1.

Referring FIGS. 1-2, the RJ45 connector 100 has an insulating housing 101, a plurality of contacts 1043 fastened in the insulating housing 101 for mating with a plug (not shown), a plurality of terminals 106 adapted to be mounted onto a PCB of an electrical device (not shown), a magnetic module 10 electrically connecting the contacts 1043 and the terminals 106 to form four signal channels carrying differential signal pairs, and a shielding cover 102, 103.

Referring to FIGS. 3-12, the magnetic module 10 has a printed circuit board (PCB) 104 and a plurality of electric elements mounted on the PCB 104. The electric elements include four transformers 1045, four common mode chokes 1046, an integrated body having four resistors 1048 and an electric capacitor 1047. The RJ45 connector 100 has four signal channels for carrying differential signal pairs. One of the transformers 1045 and one of the common mode chokes 1046 are serially connected in one of the signal channels (shown in FIG. 12).

Referring to FIGS. 6-11, the transformer 1045 includes an H-shaped magnetic core 22, a magnetic board 24 on a top side of H-shaped magnetic core 22, a primary coil 271 having a first magnetic wire 261 and a second magnetic wire 262 and a secondary coil 272 having a third magnetic wire 263 and a fourth magnetic wire 264. The H-shaped magnetic core 22 has a body portion 220, a first wall 222 and a second wall 224 and defining a horizontally longitudinal direction, a horizontally transverse direction and a vertical direction perpendicular to each other. The body portion 220 extends along the horizontally longitudinal direction. The first and the second walls 222, 224 extend along the transverse direction and respectively connected to longitudinal opposite ends of the body portion 220. The first wall 222 has four electrode pads 231-234 disposed along the transverse direction on a bottom side thereof. The second wall 224 has a plurality of electrode pads 235-238 disposed along the transverse direction on a bottom side thereof. The magnetic board 24 covers across the body portion 22 in the longitudinal direction and supported by the first and second walls 222, 224. The body portion 220 has a cross section perpendicular to the longitudinal direction, the cross section has a roughly rectangle shape with a top side and a bottom side slightly hunching up (seeing a numeral 221 shown in FIG. 8) so that the first to fourth magnetic wires 261-264 cling to the top and the bottom side thereof. The H-shaped magnetic core 22 has eight separated standoffs extending downwardly from the first and the second walls 222, 224 corresponding to the electrode pads 231-238, the electrode pads 231-238 are formed on the standoffs through plating.

The primary coil 271 includes a first magnetic wire 261 and a second magnetic wire 262. The secondary coil 272 includes a third magnetic wire 263 and a fourth magnetic wire 264. The first to fourth magnetic wires 261-264 are separated form each other. Each of the first to fourth magnetic wires 261-264 has a middle portion (not labeled) winding around the body portion 220, a first end (not labeled) connected to the electrode pads 231-234 of the first wall 222, and an opposite second end (not labeled) connected to the electrode pads 235-238 of the second wall 224. The electrode pads 231-238 are soldered onto the PCB 104 so that the first and the second magnetic wires 261-262 are serially connected to form an output, an input and a center tap of the primary coil 271 (shown in FIGS. 11-12), the third and the fourth magnetic wires 263-264 are serially connected to form an output, an input and a center tap of the secondary coil 272. In order to realize the circuit diagram shown in FIGS. 10-11, firstly, the first and the fourth magnetic wires 261, 264 are parallel wound around the body portion 220 in one time in an clockwise direction in an inner layer without any overlap; secondly, the second and the third magnetic wires 262-263 are parallel wound around body portion 220 over the inner layer in one time in a counter-clockwise direction in an outer layer without any overlap; thirdly, the five and the six electrode pads 235, 236 which are connected to the second ends of the first and the fourth magnetic wires 261, 264 are directly connected by a first conductive trace of the PCB 104; fourthly, the third and the fourth electrode pads 233, 234 which are connected to the first ends of the second and the third magnetic wires 262, 263 are directly connected by a second conductive trace of the PCB 104; fifthly, the first and the second electrode pads 231-231 are respectively electrically connected to two of the contacts 1043 through a pair of third conductive traces of the PCB 104; finally, the seventh and the eighth electrode pads 237-238 are respectively electrically connected to two of the terminals 106 through a pair of fourth conductive traces of the PCB 104.

In order to get a qualified electric performance of the connector application, the first to fourth magnetic wires 261-264 have a same diameter of 0.04 to 0.1 millimeters and a same turn number of 10 to 25 wound around the body portion 220. The body portion 220 has a longitudinal length greater than twice of a product of the diameter and the turn number. Each of the first to fourth magnetic wires 261-264 is made from a copper wire having a diameter of 0.027 to 0.05 millimeters coated with an insulating paint (shown in FIG. 10), the primary coil 271 having a direct-current resistant of no more than 5 ohms between the input and the output of the primary coil 271 and an inductance of 150 micro henries at a frequency of 100 KHz, and the secondary coil 272 having a direct-current resistant of no more than 5 ohms between the input and the output of the secondary coil 272 and an inductance of 150 micro henries at a frequency of 100 KHz.

In a preferred embodiment of the present invention, each of the first to fourth magnetic wires 261-264 has a same diameter of 0.052 to 0.063 millimeters, is made from a copper wire having a diameter of 0.039 to 0.041 millimeters covered with an insulating paint, and has a same turn number of 17 to 22 around the body portion. The body portion 220 has a longitudinal length of 2.35 to 2.80 millimeters. The magnetic core 22 has a transverse width of 3.0 to 3.4 millimeters (referred to a character "B" shown in FIG. 7) and a longitudinal length of 4.35 to 4.8 millimeters (referred to a character "A" shown in FIG. 7).

In another preferred embodiment of the present invention, each of the first to fourth magnetic wires 261-264 has a same diameter of 0.042 to 0.053 millimeters, is made from a copper wire having a diameter of 0.029 to 0.031 millimeters covered with a insulating paint, and has a same turn number of 15 to 19 around the body portion 220. The body portion 220 has a longitudinal length of 1.60 to 2.20 millimeters. The magnetic core 22 has a transverse width of 3.0 to 3.4 millimeters and a longitudinal length of 3.0 to 3.5 millimeters.

The PCB 104 is vertically fixed to the housing 101 and has a front face and a back face. Two of the transformers 1045 and two of the common mode chokes 1046 corresponding to two signal channels are mounted on the front face. Two of the transformers 1045 and two of the common mode chokes 1046 corresponding to the left two signal channels mounted on the back face. In order to get a lower profile, the transformer has a height of 2.5 to 5.0 millimeters, and the body portion has a height of 1.15 to 1.50 millimeters. It should be understood that the height is also critical to the electric performance of the transformers 1045, especially the inductance, the residence and high voltage. The four resistors in the integral body 1048 and the electric capacitor 1047 are mounted on a lower area of the front face and the terminals 106 integrated in a foot module 1044 and mounted on a lower area of the back face.

The first, the second, the fifth and the sixth electrode pads 231-232, 235-236 connecting the primary coil 271 are disposed near transversely left ends of the first and the second walls 222, 224. The left electrode pads 233-234, 237-238 connecting the secondary coil are disposed near transversely right ends of the first and the second walls 222, 224. When a high voltage withstand test of A.C. 1,500 volts or D.C. 2250 volts is request, a narrowest space between the second and the third electric pads 232, 233 or the sixth and seventh electrode pads 236, 236 should be designed between 1.4 and 1.6 millimeters.

In preferred embodiments, the present invention could be applied in 10/100 base, 1 gigabit and 10 gigabit Ethernet, which defined under IEEE 802.3 committee, and should meet corresponding electrical characteristic requirements under such applications.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An RJ45 connector comprising:

a housing;

a plurality of contacts fastened in the housing for mating with a plug;

a plurality of terminals for connecting an electrical device; and a magnetic module electrically connecting the contacts and the terminals to form a plurality of signal channels carrying differential signal pairs, the magnetic module having a printed circuit board (PCB) and a transformer mounted thereon, wherein the transformer is connected in one of the signal channels and comprises:

an H-shaped magnetic core defining a horizontally longitudinal direction, a horizontally transverse direction and a vertical direction mutually perpendicular to each other, the H-shaped magnetic core having a body portion extending along the horizontally longitudinal direction, a first and a second walls perpendicular to the longitudinal direction and respectively connected to longitudinal opposite ends of the body portion, the first and the second walls each having a plurality of electrode pads disposed along the transverse direction on a bottom side thereof; and a magnetic board covering across the body portion and supported by the first and second walls, a primary coil having a first magnetic wire and a second magnetic wire; and a secondary coil having a third magnetic wire and a fourth magnetic wire; wherein each of the first to fourth magnetic wires has a middle portion winding around the body portion, a first end and an opposite second end connected to the electrode pads, the electrode pads soldered onto the PCB so that the first and the second magnetic wires are serially connected to form an output, an input and a center tap of the primary coil, the third and the fourth magnetic wires are serially connected to form an output, an input and a center tap of the secondary coil; wherein the output and input of the primary coil are respectively electrically connected to two of the contacts through some circuits of the PCB, and the output and input of the secondary coil are respectively electrically connected to two of the terminals through some other circuits of the PCB; wherein each of the first to fourth magnetic wires is made from a copper wire having a diameter of 0.027 to 0.05 millimeters coated with an insulating paint, the body portion having a longitudinal length greater than twice of a product of the diameter and the turn number, the primary coil having a direct-current resistant of no more than 5 ohms between the input and the output of the primary coil and an inductance of 150 micro henries at a frequency of 100 KHz, and the secondary coil having a direct-current resistant of no more than 5 ohms between the input and the output of the secondary coil and an inductance of 150 micro henries at a frequency of 100 KHz.

2. The electrical connector as claimed in claim 1, wherein the first and the fourth magnetic wires are parallel wound around the magnetic body in an inner layer without any overlap, and the second and the third magnetic wires are parallel wound around the inner layer in an outer layer without any overlap.

3. The electrical connector as claimed in claim 2, wherein the body portion has a cross section perpendicular to the longitudinal direction, the cross section has a roughly rectangle shape with a top side and a bottom side slightly hunching up so that the first to fourth magnetic wires cling to the top and the bottom side.

4. The electrical connector as claimed in claim 1, having only one port, wherein there are four signal channels and each of the other channels has a same transformer as described before, and each of the signal channels further having a common mode choke, the PCB vertically fixed and having a front face and a back face, part of the transformers and the common mode chokes mounted on the front face and the others mounted on the back face.

5. The electrical connector as claimed in claim 1, wherein the transformers and the common mode chokes of two signal channels are mounted on the front face of the PCB and the transformers and the common mode chokes of the other two signal channels are mounted on the back face of the PCB, the magnetic module further having four resistors formed in an integral body and an electric capacitor, the integral body and the electric capacitor mounted on a lower area of the front face and the terminals integrated in a foot module and mounted on a lower area of the back face.

6. The electrical connector as claimed in claim 1, wherein the electrode pads are divided into a first group connecting the primary coil disposed near transversely left ends of the first and the second walls, and a second group connecting the secondary coil disposed near transversely right ends of the first and the second walls, a narrowest space between the electric pads of the first group and the electric pads of the second group is 1.4 to 1.6 millimeters.

7. The electrical connector as claimed in claim 6, wherein the H-shaped magnetic core has a plurality of standoffs corresponding to the electrode pads, the electrode pads are formed on the standoffs through plating.

8. A high speed RJ45 connector comprising:

a housing;

a plurality of contacts fastened in the housing for mating with a plug;

a plurality of terminals for connecting an electrical device; and a magnetic module electrically connecting the contacts and the terminals to form a plurality of signal channels carrying differential signal pairs, the magnetic module having a printed circuit board (PCB) and a transformer mounted thereon, wherein the transformer is connected in one of the signal channels and comprises:

an H-shaped magnetic core defining a horizontally longitudinal direction, a horizontally transverse direction and a vertical direction mutually perpendicular to each other, the H-shaped magnetic core having a body portion extending along the horizontally longitudinal direction, a first and a second walls perpendicular to the longitudinal direction and respectively connected to longitudinal opposite ends of the body portion, the first and the second walls each having a plurality of electrode pads disposed along the transverse direction on a bottom side thereof; and a magnetic board covering across the body portion and supported by the first and second walls, a primary coil having a first magnetic wire and a second magnetic wire; and a secondary coil having a third magnetic wire and a fourth magnetic wire; wherein each of the first to fourth magnetic wires has a middle portion winding around the body portion, a first end and an opposite second end connected to the electrode pads, the electrode pads soldered onto the PCB so that the first and the second magnetic wires are serially connected to form an output, an input and a center tap of the primary coil, the third and the fourth magnetic wires are serially connected to form an output, an input and a center tap of the secondary coil; wherein the output and input of the primary coil are respectively electrically connected to two of the contacts through some circuits of the PCB, and the output and input of the secondary coil are respectively electrically connected to two of the terminals through some other circuits of the PCB; wherein each of the first to fourth magnetic wires has a same diameter of 0.042 to 0.053 millimeters, is made from a copper wire having a diameter of 0.029 to 0.031 millimeters covered with a insulating paint, and has a same turn number of 15 to 19 around the body portion, the body portion having a longitudinal length of 1.60 to 2.20 millimeters, and the magnetic core having a transverse width of 3.0 to 3.4 millimeters and a longitudinal length of 3.0 to 3.5 millimeters, the transformer having a height of 2.5 to 5.0 millimeters, and the body portion has a height of 1.15 to 1.50 millimeters.

9. The electrical connector as claimed in claim 8, wherein the body portion has a cross section perpendicular to the longitudinal direction, the cross section has a roughly rectangle shape with a top side and a bottom side slightly hunching up so that the first to fourth magnetic wires cling to the top and the bottom side.

10. The electrical connector as claimed in claim 9, having a plurality of ports, wherein each port has four signal channels and each of the channels has a same transformer as described before, and each of the signal channels further having a common mode choke, the PCB vertically fixed and having a front face and a back face, part of the transformers and the common mode chokes mounted on the front face and the others mounted on the back face.

11. The electrical connector as claimed in claim 10, wherein the transformers and the common mode chokes of two signal channels are mounted on the front face of the PCB and the transformers and the common mode chokes of the other two signal channels are mounted on the back face of the PCB, the magnetic module further having four resistors formed in an integral body and an electric capacitor, the integral body and the electric capacitor mounted on a lower area of the front face and the terminals integrated in a foot module and mounted on a lower area of the back face.

12. The electrical connector as claimed in claim 8, wherein the electrode pads are divided into a first group connecting the primary coil disposed near transversely left ends of the first and the second walls, and a second group connecting the secondary coil disposed near transversely right ends of the first and the second walls, a narrowest space between the electric pads of the first group and the electric pads of the second group is 1.4 to 1.6 millimeters.

13. The electrical connector as claimed in claim 8, wherein the H-shaped magnetic core has a plurality of standoffs corresponding to the electrode pads, the electrode pads are formed on the standoffs through plating.

14. A high speed RJ45 connector comprising:

a housing;

a plurality of contacts fastened in the housing for mating with a plug;

a plurality of terminals for connecting an electrical device; and a magnetic module electrically connecting the contacts and the terminals to form a plurality of signal channels carrying differential signal pairs, the magnetic module having a printed circuit board (PCB) and a transformer mounted thereon, wherein the transformer is connected in one of the signal channels and comprises:

an H-shaped magnetic core defining a horizontally longitudinal direction, a horizontally transverse direction and a vertical direction mutually perpendicular to each other, the H-shaped magnetic core having a body portion extending along the horizontally longitudinal direction, a first and a second walls perpendicular to the longitudinal direction and respectively connected to longitudinal opposite ends of the body portion, the first and the second walls each having a plurality of electrode pads disposed along the transverse direction on a bottom side thereof; and a magnetic board covering across the body portion and supported by the first and second walls, a primary coil having a first magnetic wire and a second magnetic wire; and a secondary coil having a third magnetic wire and a fourth magnetic wire; wherein each of the first to fourth magnetic wires has a middle portion winding around the body portion, a first end and an opposite second end connected to the electrode pads, the electrode pads soldered onto the PCB so that the first and the second magnetic wires are serially connected to form an output, an input and a center tap of the primary coil, the third and the fourth magnetic wires are serially connected to form an output, an input and a center tap of the secondary coil; wherein the output and input of the primary coil are respectively electrically connected to two of the contacts through some circuits of the PCB, and the output and input of the secondary coil are respectively electrically connected to two of the terminals through some other circuits of the PCB; wherein each of the first to fourth magnetic wires has a same diameter of 0.052 to 0.063 millimeters, is made from a copper wire having a diameter of 0.039 to 0.041 millimeters covered with an insulating paint, and has a same turn number of 17 to 22 around the body portion, the body portion having a longitudinal length of 2.35 to 2.80 millimeters, and the magnetic core having a transverse width of 3.0 to 3.4 millimeters and a longitudinal length of 4.35 to 4.8 millimeters, the transformer having a height of 2.5 to 5.0 millimeters, and the body portion having a height of 1.15 to 1.50 millimeters.

15. The electrical connector as claimed in claim 14, wherein the body portion has a cross section perpendicular to the longitudinal direction, the cross section has a roughly rectangle shape with a top side and a bottom side slightly hunching up so that the first to fourth magnetic wires cling to the top and the bottom side.

16. The electrical connector as claimed in claim 14, having a plurality of ports, wherein each port has four signal channels and each of the channels has a same transformer as described before, and each of the signal channels further having a common mode choke, the PCB vertically fixed and having a front face and a back face, part of the transformers and the common mode chokes mounted on the front face and the others mounted on the back face.

17. The electrical connector as claimed in claim 16, wherein the transformers and the common mode chokes of two signal channels are mounted on the front face of the PCB and the transformers and the common mode chokes of the other two signal channels are mounted on the back face of the PCB, the magnetic module further having four resistors formed in an integral body and an electric capacitor, the integral body and the electric capacitor mounted on a lower area of the front face and the terminals integrated in a foot module and mounted on a lower area of the back face.

18. The electrical connector as claimed in claim 17, wherein the electrode pads are divided into a first group connecting the primary coil disposed near transversely left ends of the first and the second walls, and a second group connecting the secondary coil disposed near transversely right ends of the first and the second walls, a narrowest space between the electric pads of the first group and the electric pads of the second group is 1.4 to 1.6 millimeters.

19. The electrical connector as claimed in claim 14, wherein the H-shaped magnetic core has a plurality of standoffs corresponding to the electrode pads, the electrode pads are formed on the standoffs through plating.

* * * * *